US010576732B2

(12) United States Patent
Kagaya et al.

(10) Patent No.: US 10,576,732 B2
(45) Date of Patent: Mar. 3, 2020

(54) PRINTER AND PRINTING METHOD

(71) Applicants: DENSO TEN Limited, Kobe-shi, Hyogo (JP); Muramoto Industry CO., LTD, Kobe-shi, Hyogo (JP)

(72) Inventors: Yoshinori Kagaya, Kobe (JP); Naoya Tonou, Kobe (JP); Masaaki Fukushima, Kobe (JP); Hitoshi Nakaarai, Hyogo (JP); Kazuhito Matsuyama, Hyogo (JP); Yoshiyuki Kondou, Hyogo (JP)

(73) Assignees: DENSO TEN LIMITED, Kobe-shi (JP); MURAMOTO INDUSTRY CO., LTD., Kobe-shi (JP)

( * ) Notice: Subject to any disclaimer, the term of this patent is extended or adjusted under 35 U.S.C. 154(b) by 0 days.

(21) Appl. No.: 15/991,640

(22) Filed: May 29, 2018

(65) Prior Publication Data

US 2018/0370218 A1 Dec. 27, 2018

(30) Foreign Application Priority Data

Jun. 27, 2017 (JP) ..... 2017-125565

(51) Int. Cl.

| | |
|---|---|
| ***B41F 15/08*** | (2006.01) |
| ***B41F 15/38*** | (2006.01) |
| ***B41M 1/12*** | (2006.01) |
| ***B41F 15/30*** | (2006.01) |

(52) U.S. Cl.

CPC ..... *B41F 15/0818* (2013.01); *B41F 15/0895* (2013.01); *B41F 15/30* (2013.01); *B41F 15/38* (2013.01); *B41M 1/12* (2013.01)

(58) Field of Classification Search

CPC ..... B41F 15/0895; B41F 15/16; B41F 15/18; B41F 15/30; B41F 15/28; B41F 15/08; B41F 15/26; B41F 15/22; B41M 1/12

USPC ..... 101/126, 35, 41

See application file for complete search history.

(56) References Cited

U.S. PATENT DOCUMENTS

| | | | | |
|---|---|---|---|---|
| 2,491,947 A * | 12/1949 | Bardash | B41F 17/18 | 101/35 |
| 5,090,320 A * | 2/1992 | Nave | B41F 15/0895 | 101/126 |
| 5,368,808 A * | 11/1994 | Koike | B29D 22/003 | 101/35 |
| 8,807,031 B2 * | 8/2014 | Styles | B41J 3/4073 | 101/126 |

FOREIGN PATENT DOCUMENTS

| | | |
|---|---|---|
| JP | 2012-170876 A | 9/2012 |
| JP | 2014-086544 A | 5/2014 |

* cited by examiner

*Primary Examiner* — Leslie J Evanisko
(74) *Attorney, Agent, or Firm* — Oliff PLC

(57) ABSTRACT

A printer according to an embodiment includes a holding part and a printing part. The holding part holds a print substrate having a curved surface in a state where the print substrate is pressed and elastically deformed so that a curvature of the curved surface is small. The printing part performs silkscreen printing on a print surface of the print substrate held by the holding part.

6 Claims, 4 Drawing Sheets

PRINTER AND PRINTING METHOD

CROSS-REFERENCE TO RELATED APPLICATION

This application is based upon and claims the benefit of priority of the prior Japanese Patent Application No. 2017-125565, filed on Jun. 27, 2017, the entire contents of which are incorporated herein by reference.

FIELD

The embodiment discussed herein is directed to a printer and a printing method.

BACKGROUND

Conventionally, there has been known a printer in which a screen printing plate is mounted on a print substrate and printing ink is squeegeed by a squeegee so as to perform silkscreen printing on the print substrate (see, e.g., Japanese Laid-open Patent Publication No. 2014-086544).

However, in the above-mentioned printer, performing the screen printing on a print substrate having a curved surface is not taken into account.

SUMMARY

A printer according to an embodiment includes a holding part and a printing part. The holding part holds a print substrate having a curved surface in a state where the print substrate is pressed and elastically deformed so that a curvature of the curved surface is small. The printing part performs silkscreen printing on a print surface of the print substrate held by the holding part.

DESCRIPTION OF EMBODIMENT

Hereinafter, a printer and a printing method disclosed in the present application will be described in detail with reference to the accompanying drawings. Moreover, an embodiment described below is merely one example, and not intended to limit the present disclosure.

Print Substrate

Figure 1:
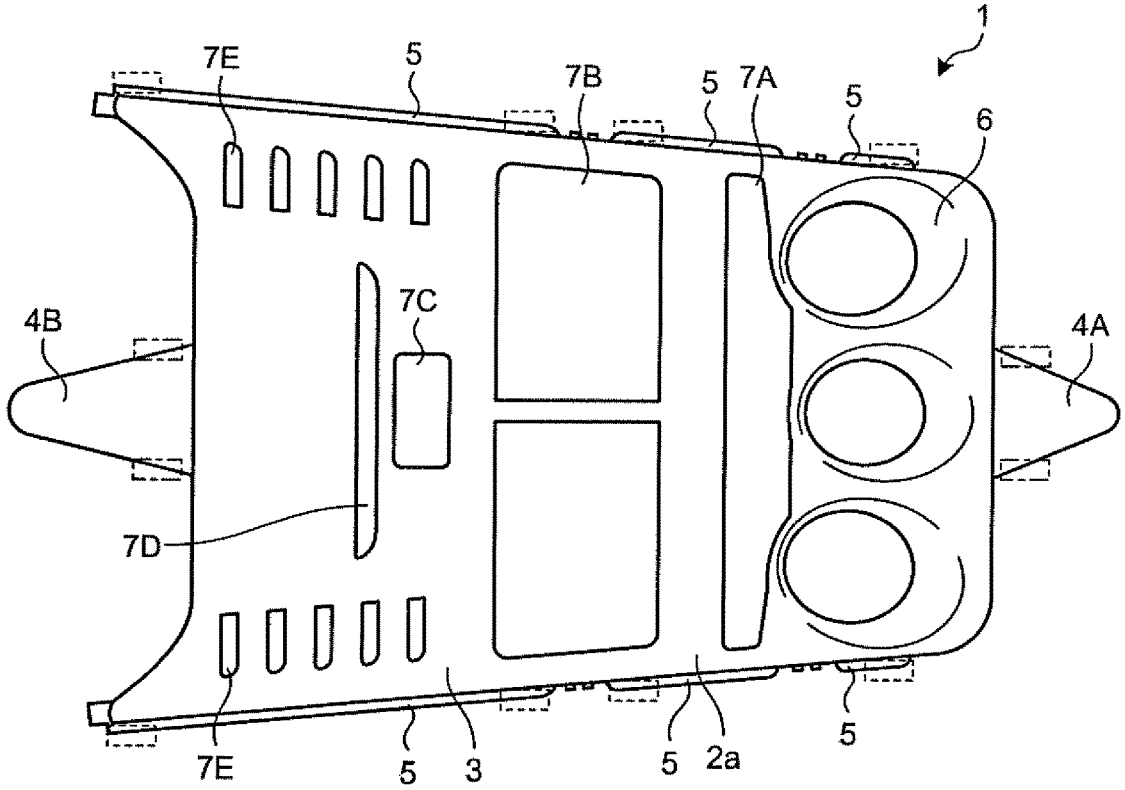
FIG. 1 is a plan view illustrating a print substrate.

First, a print substrate 1 will be explained with reference to FIG. 1 on which a printer 10 (see FIG. 2) according to the present embodiment performs silkscreen printing. FIG. 1 is a plan view illustrating the print substrate 1. The print substrate 1 illustrated in FIG. 1 indicates a plan view of the print substrate 1 when a print surface 2*a* on which the silkscreen printing is performed is an upper side. Hereinafter, a surface 2*b* (see FIG. 2) reverse to the print surface 2*a* may be referred to as the "reverse surface 2*b*".

The print substrate 1 is a design panel for back-surface printing having the print surface 2*a* as a back surface and the reverse surface 2*b* as a front surface, and has a curved surface. Specifically, the print substrate 1 is formed in a curved-surface shape obtained by curving the print surface 2*a* at a predetermined curvature. The print substrate 1 is used for a center panel of a vehicle, for example. The print substrate 1 is formed by an injected molding resin, for example. Any of a polypropylene (PP), a polycarbonate (PC), a polyethylene terephthalate (PET), and an acrylic resin (polymethyl methacrylate: PMMA) among other things may be used as the resin.

The print substrate 1 includes: a main body 3 that becomes a design panel; gates 4A and 4B; and ribs 5. The gates 4A and 4B and the ribs 5 are formed on an outer periphery of the main body 3, in other words, a periphery of the print substrate 1. The gates 4A and 4B are formed on respective both ends of the print substrate 1 in a longitudinal direction. The ribs 5 are formed on both ends of the print substrate 1 in a lateral direction. The gates 4A and 4B and the ribs 5 are cut off after the screen printing.

In the main body 3, a plurality of cylindrical protruding parts 6 that protrudes from the reverse surface 2*b* is formed. A plurality of holes 7A to 7E is formed in the main body 3. The protruding parts 6 and the holes 7A to 7E are formed depending on a use of the design panel, and whose shapes are not limited to those illustrated in FIG. 1. The main body 3 may be without the protruding parts 6 and/or the holes 7A to 7E.

Printer

Figure 2:
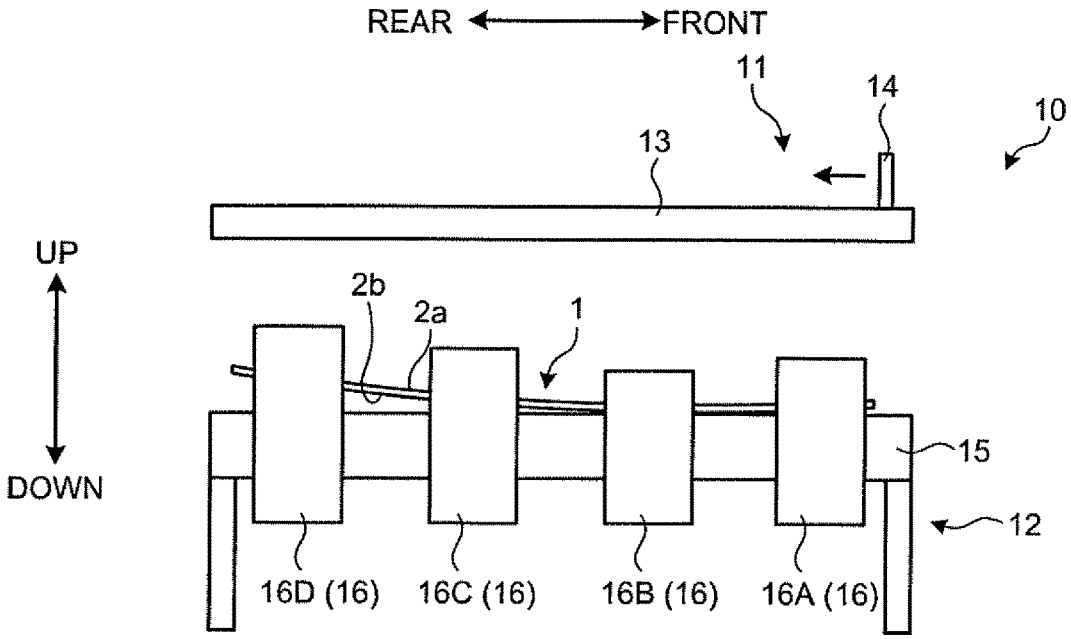
FIG. 2 is a schematic view illustrating a printer according to a present embodiment.

Next, the printer 10 according to the present embodiment will be explained with reference to FIG. 2. FIG. 2 is a schematic view illustrating the printer 10 according to the present embodiment. The printer 10 is constituted of a printing part 11 and a holding part 12.

The printing part 11 has a screen printing plate 13 and a squeegee 14. The screen printing plate 13 is formed by putting a mesh (not illustrated) on a frame (not illustrated). A lower end of the squeegee 14 is formed to be substantially parallel to the horizontal direction. In other words, the printing part 11 has a similar configuration to a printing part that performs silkscreen printing on a conventional print substrate having a plane-formed print surface. The printing part 11 moves the squeegee 14 and pushes out, from an opening (not illustrated) of the screen printing plate 13, printing ink placed on the screen printing plate 13 by using the squeegee 14 so as to apply the printing ink to the print substrate 1.

Hereinafter, a horizontal direction in which the squeegee 14 moves is described as a front-and-rear direction, a horizontal direction perpendicular to the front-and-rear direction is described as a left-and-right direction, and a direction perpendicular to the horizontal directions is described as an up-and-down direction. The front-and-rear direction coincides with a longitudinal direction of the print substrate 1, and the left-and-right direction coincides with a lateral direction of the print substrate 1.

The holding part 12 is constituted of a pedestal 15 that is a fixed part, and pressing parts 16 that are movable parts. The holding part 12 presses the print substrate 1 to elastically deform the print substrate 1 so that the curvature of the curved surface of the print substrate 1 becomes small. In other words, the holding part 12 presses the print substrate 1 in the up-and-down direction, corrects the curved surface of the print substrate 1 so as to make the print surface 2*a* of the print substrate 1 plane, and holds the print substrate 1. The holding part 12 functions as a jig in performing silkscreen printing. The plane means a shape in which the printing part 11 is able to perform silkscreen printing, and includes a state having a concave and/or a convex with respect to a horizontal direction.

Figure 3:
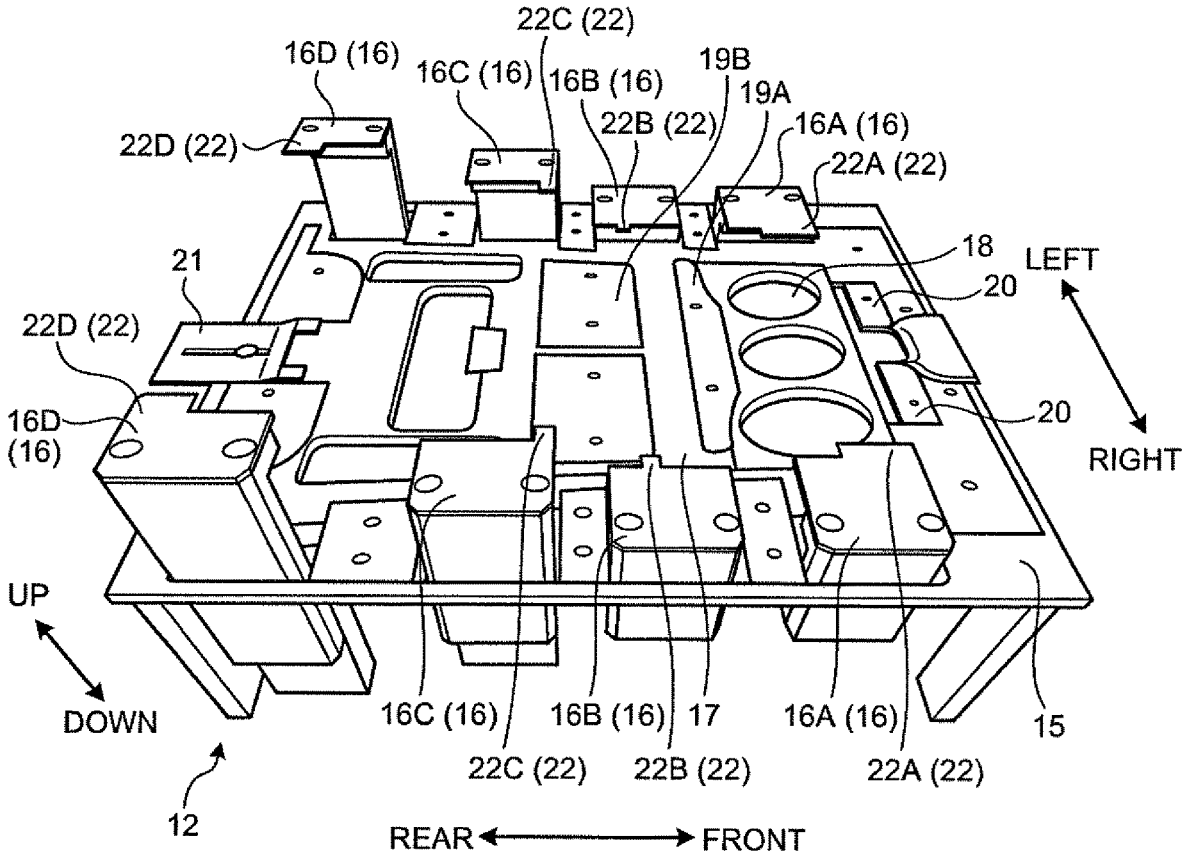
FIG. 3 is a perspective view illustrating a holding part.

As illustrated in FIG. 3, the pedestal 15 has a mounting part 17 on which the print substrate 1 is mounted. FIG. 3 is a perspective view illustrating the holding part 12.

In the mounting part 17, insertion holes 18 are formed into which the protruding parts 6 of the print substrate 1 are inserted. In the mounting part 17, insertion parts 19A and 19B are formed that are inserted into the holes 7A and 7B of the print substrate 1. The insertion parts 19A and 19B are formed so that upper ends of the insertion parts 19A and 19B do not protrude from the print surface 2*a* when being inserted into the holes 7A and 7B of the print substrate 1.

The insertion holes 18 and the insertion parts 19A and 19B prevent a position of the print substrate 1 from deviating with respect to the pedestal 15 when the curved surface of the print substrate 1 is corrected.

The pedestal 15 includes: first engaging parts 20 that are to be engaged with the gate 4A that is formed in a front portion of the print substrate 1; and a second engaging part 21 that is to be engaged with the gate 4B that is formed in a rear portion of the print substrate 1.

The two first engaging parts 20 are provided in a front portion the pedestal 15 while interposing a predetermined distance therebetween. The first engaging parts 20 form a gap to the mounting part 17. When the gate 4A is inserted into the gap formed between the mounting part 17 and the first engaging parts 20, the gate 4A is in contact with the first engaging parts 20, and the first engaging parts 20 are engaged with the gate 4A.

The second engaging part 21 is arranged in a rear portion of the pedestal 15 to be slidable in the front-and-rear direction. The second engaging part 21 forms a gap between an end part in a front portion of the second engaging part 21 and the mounting part 17. The second engaging part 21 is slid forward after the curved surface of the print substrate 1 is corrected, and thus the end part in the front portion of the second engaging part 21 is engaged with the gate 4B. When the second engaging part 21 is slid rearward after the silkscreen printing, the engagement between the end part in the front portion of the second engaging part 21 and the gate 4B is released.

In FIG. 1, for convenience of explanation, the portions to be engaged with the first engaging parts 20 and the second engaging part 21 are enclosed by using rectangular-shaped dashed lines.

Returning to FIG. 3, the plurality of pressing parts 16 is arranged on the periphery of the mounting part 17. Specifically, the pressing parts 16, whose number is four, are arranged side by side in the front-and-rear direction on the right side from the mounting part 17. The pressing parts 16, whose number is four, are arranged side by side in the front-and-rear direction on the left side from the mounting part 17. Four pairs of the pressing parts 16 are provided while pairing the two pressing parts 16 that are facing each other in the left-and-right direction. The pressing parts 16 are moved in the up-and-down direction by a hydraulic actuator and/or an electric actuator.

Hereinafter, the paired pressing parts 16 may be described as first pressing parts 16A, second pressing parts 16B, third pressing parts 16C, and fourth pressing parts 16D from the front in this order.

The pressing parts 16 have claw parts 22 that protrude inward with respect to the left-and-right direction, in other words, toward the mounting part 17. When the pressing parts 16 move downward from a state where the print substrate 1 is mounted on the mounting part 17, the claw parts 22 are engaged with the ribs 5 of the print substrate 1. When the pressing parts 16 move downward in a state where the claw parts 22 are engaged with the ribs 5, the pressing parts 16 press down the print substrate 1 in accordance with the move of the pressing parts 16, and corrects the curved surface of the print substrate 1 so as to make the print surface 2*a* of the print substrate 1 plane. In other words, the pressing parts 16 press the ribs 5 of the print substrate 1 by using the claw parts 22 so as to correct the curved surface of the print substrate 1.

Claw parts 22A of the first pressing parts 16A are provided on the front side so as to press front end portions of the ribs 5 of the print substrate 1. Claw parts 22D of the fourth pressing part 16D are provided on the rear side so as to press rear end portions of the ribs 5 of the print substrate 1. Thus, it is possible to press the end portions in the front-and-rear direction of the print substrate 1 to be able to hold the end portions of the print surface 2*a* in a plane state.

In FIG. 1, for convenience of explanation, the portions to be pressed by the claw parts 22 are enclosed by using rectangular-shaped dashed lines.

Returning to FIG. 3, the pressing parts 16 first press a portion, in which the protruding parts 6 are formed, of the print substrate 1. Specifically, the first pressing parts 16A first press a front portion, in which the protruding parts 6 are formed, of the print substrate 1. Next, the second pressing parts 16B, the third pressing parts 16C, and the fourth pressing parts 16D press portion, in which the reverse surface 2*b* of the print substrate 1 is flat.

The pressing parts 16 sequentially press the print substrate 1 from one end toward the other end of the print substrate 1. Specifically, the first pressing parts 16A, the second pressing parts 16B, the third pressing parts 16C, and the fourth pressing parts 16D sequentially press the print substrate 1 in this order from the front toward the rear.

Printing Procedure

Figure 4:
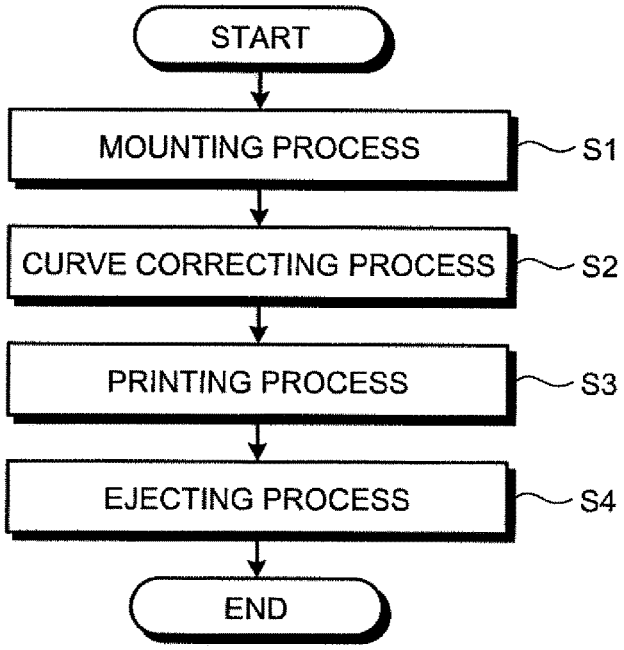
FIG. 4 is a flowchart illustrating a printing procedure according to the present embodiment.

Next, a printing procedure for silkscreen printing to be performed by the printer 10 according to the present embodiment will be explained with reference to FIG. 4. FIG. 4 is a flowchart illustrating the printing procedure according to the present embodiment.

Figure 5:
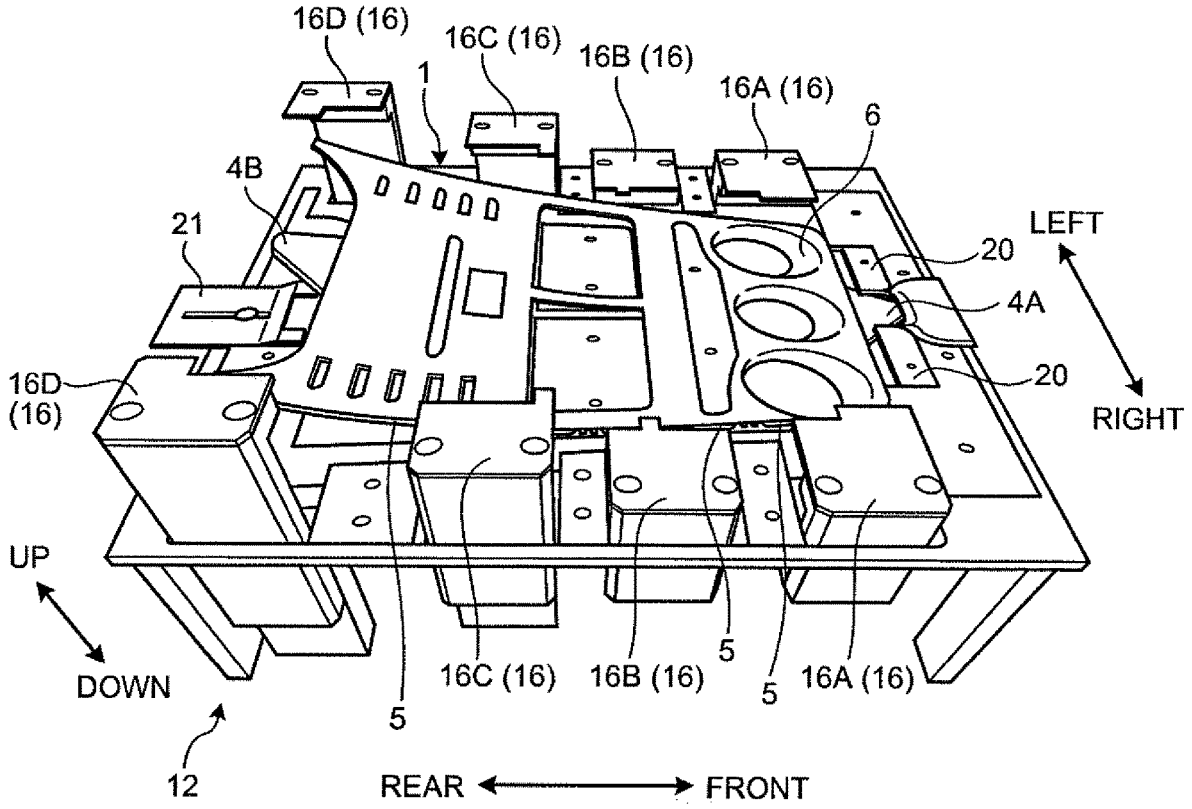
FIG. 5 is a diagram illustrating a state where the print substrate is mounted on a pedestal.

First, a mounting process is performed (Step S1). The print substrate 1 is mounted on the mounting part 17 so that the gate 4A formed in the front portion of the print substrate 1 is engaged with the first engaging parts 20. In this case, the protruding parts 6 of the print substrate 1 are inserted into the insertion holes 18 formed in the mounting part 17. As illustrated in FIG. 5, the print substrate 1 includes a curved surface to have a curved-surface shape, and thus the print substrate 1 warps more upward as going closer to its rear end. FIG. 5 is a diagram illustrating a state where the print substrate 1 is mounted on the mounting part 17. In this state, the pressing parts 16 are stopped at predetermined upward positions.

Returning to FIG. 4, next, the printer 10 performs a curve correcting process (Step S2). The printer 10 presses the part in which the protruding parts 6 are formed on the reverse surface 2*b*. The printer 10 causes the pressing parts 16 to sequentially move downward from the front toward the rear so as to correct the curved surface of the print substrate 1 by using the pressing parts 16.

The printer 10 first causes the first pressing parts 16A to move downward so as to engage the claw parts 22A of the first pressing parts 16A with the ribs 5 of the print substrate 1.

Next, the printer 10 causes the first pressing parts 16A to further move downward. Thus, the first pressing parts 16A press the part in which the protruding parts 6 are formed on the reverse surface 2*b* thereof. The printer 10 causes the second pressing parts 16B to move downward so as to engage claw parts 22B of the second pressing parts 16B with the ribs 5 of the print substrate 1.

Next, the printer 10 causes the third pressing parts 16C to move downward while causing the first pressing parts 16A and the second pressing parts 16B to move downward, so as to engage claw parts 22C of the third pressing parts 16C with the ribs 5 of the print substrate 1.

Furthermore, the printer 10 causes the fourth pressing parts 16D to move downward while causing the first pressing parts 16A, the second pressing parts 16B, and the third pressing parts 16C to move downward, so as to engage the claw parts 22D of the fourth pressing parts 16D with the ribs 5 of the print substrate 1.

When having moved to predetermined positions, the pressing parts 16 stop at the positions. The predetermined positions are positions at which the print surface 2*a* of the print substrate 1 becomes substantially plane, and are previously set. For example, when the first pressing parts 16A have moved to the predetermined positions while the third pressing parts 16C is moving downward, the first pressing parts 16A stop at the predetermined positions.

When the fourth pressing parts 16D have moved to the predetermined positions, the second engaging part 21 is slid forward so as to engage the second engaging part 21 with the gate 4B formed in the rear portion of the print substrate 1.

Figure 6:
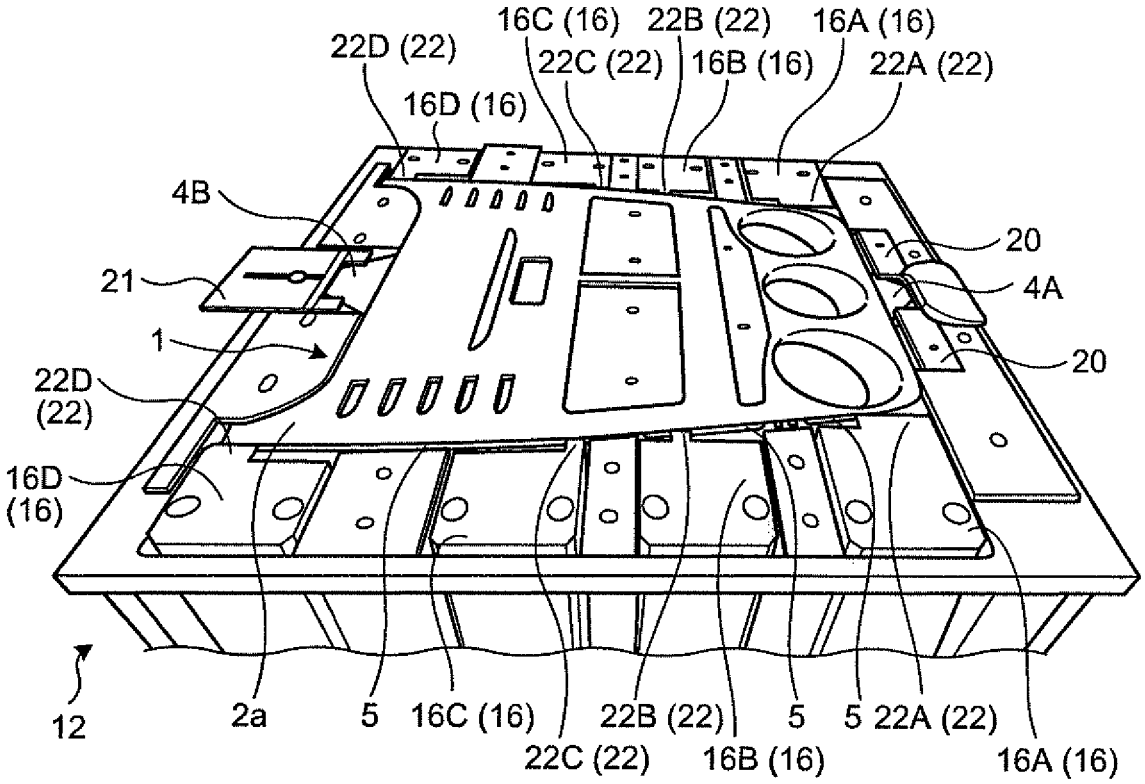
FIG. 6 is a diagram illustrating a state where a curved surface of the print substrate is corrected by pressing parts.

As described above, by moving the pressing parts 16 downward, the curved surface of the print substrate 1 is corrected, and the print surface 2*a* becomes plane as illustrated in FIG. 6. FIG. 6 is a diagram illustrating a state where the curved surface of the print substrate 1 is corrected by the pressing parts 16. The print substrate 1 is held in a state where the holding part 12 has made the print surface 2*a* plane.

Next, the printer 10 performs a printing process (Step S3). The printer 10 performs silkscreen printing on the print surface 2*a* of the print substrate 1 by using the printing part 11. The printer 10 may perform the printing process at a plurality of times to complete the silkscreen printing.

Next, the printer 10 performs an ejecting process (Step S4). The printer 10 moves the pressing parts 16 upward. The printer 10 slides the second engaging part 21 rearward. Thus, a shape of the print substrate 1 that is held to be plane returns to an original shape having a curved surface. Next, the print substrate 1 ejected from the printer 10.

Effects

The printer 10 holds the print substrate 1 having a curved surface in a state where the print substrate 1 is pressed and elastically deformed by using the holding part 12 so that a curvature of the curved surface is small, so as to perform silkscreen printing on the print surface 2*a* of the print substrate 1. Specifically, the printer 10 makes the print substrate 1 plane so as to perform silkscreen printing. Thus, it is possible to easily perform silkscreen printing on the print substrate 1 having a curved surface.

The printer 10 presses the ribs 5 formed on a periphery of the print substrate 1 by using the claw parts 22. Thus, the print substrate 1 is able to be pressed without leaving any pressed mark on the main body 3 that is to be a design panel, so that it is possible to manufacture a design panel having a good appearance.

The printer 10 first presses the part, in which the protruding parts 6 are formed on the reverse surface 2*b* of the print substrate 1, by using the first pressing parts 16A, next, presses a portion having the flat reverse surface 2*b* by using the second pressing parts 16B, the third pressing parts 16C, and the fourth pressing parts 16D. Thus, it is possible to prevent a position of the print substrate 1 from deviating with respect to the pedestal 15 when the print substrate 1 is being pressed to be able to precisely perform the silkscreen printing. When a positional deviation of the print substrate 1 is suppressed, it is possible to prevent the pressing parts 16 from pressing the main body 3, and thus manufacturing efficiency is able to be improved, so that it is possible to manufacture a design panel having a good appearance.

The printer 10 sequentially presses the print substrate 1 from one end toward the other end of the print substrate 1. For example, the printer 10 sequentially presses the print substrate 1 from its front portion toward rear portion. Thus, it is possible to prevent a position of the print substrate 1 from deviating with respect to the pedestal 15 when the print substrate 1 is being pressed to be able to precisely perform the silkscreen printing. When a positional deviation of the print substrate 1 is suppressed, it is possible to prevent the pressing parts 16 from pressing the main body 3, and thus a design panel having a good appearance is able to be manufactured, so that it is possible to improve manufacturing efficiency.

Modification

Figure 7:
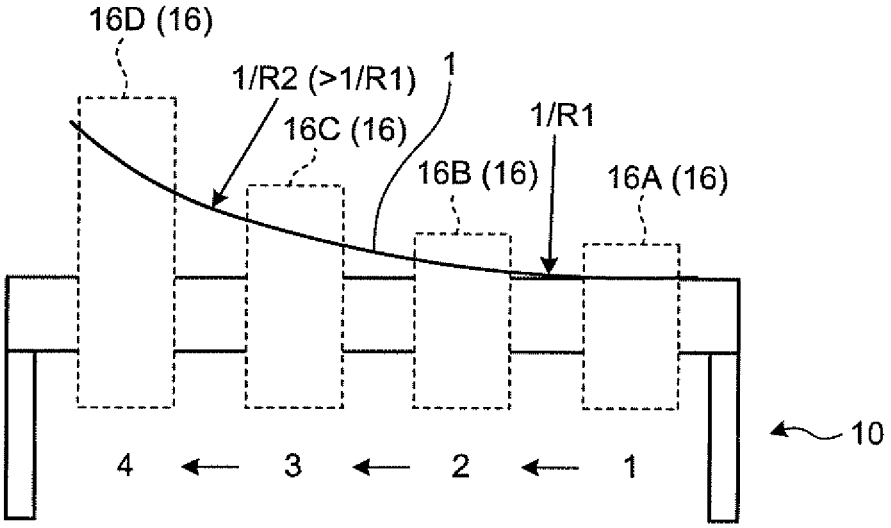
FIG. 7 is a diagram illustrating a pressing order of the print substrate in a printer according to a modification.

When the print substrate 1 has a plurality of curved surfaces having different curvatures, the printer 10 may press the print substrate 1 in an order from a part having a small curvature to a part having a large curvature of the curved surface of the print substrate 1. For example, as illustrated in FIG. 7, when silkscreen printing is performed on the print substrate 1 that includes a curved surface having two different curvatures (1/R1 and 1/R2 (>1/R1)), the printer 10 presses the print substrate 1 in an order from a part having the small curvature to a part having the large curvature. Specifically, the printer 10 moves downward the first pressing parts 16A, the second pressing parts 16B, the third pressing parts 16C, and the fourth pressing parts 16D in this order, so as to sequentially press the print substrate 1 by using the first pressing parts 16A, the second pressing parts 16B, the third pressing parts 16C, and the fourth pressing parts 16D in this order. FIG. 7 is a diagram illustrating a pressing order of the print substrate 1 in the printer 10 according to a modification. In FIG. 7, for convenience of explanation, the first pressing parts 16A, the second pressing parts 16B, the third pressing parts 160, and the fourth pressing parts 16D are indicated by using dashed lines.

When the print substrate 1 includes a plane-shaped part, the printer 10 first presses the plane-shaped part by using the pressing parts 16.

Thus, it is possible to prevent a position of the print substrate 1 from deviating with respect to the pedestal 15 when the curved surface of the print substrate 1 having different curvatures is being pressed to be able to precisely perform the silkscreen printing. When a positional deviation of the print substrate 1 is suppressed, it is possible to prevent the pressing parts 16 from pressing the main body 3, and thus manufacturing efficiency is able to be improved, so that it is possible to manufacture a design panel having a good appearance.

For example, when the curved surface of the print substrate 1 is not able to be corrected to be plane due to a curvature of the curved surface or material quality of the print substrate 1, the printer 10 corrects the curved surface of the print substrate 1 so that the curvature of the curved surface becomes small within a range of elastic deformation of the print substrate 1. The printer 10 performs silkscreen printing by using the squeegee 14 having a curved surface according to the corrected shape (elastically deformed shape) of the print substrate 1. Thus, it is possible to perform silkscreen printing on the print substrate 1 having a curved surface, even when the curved surface of the print substrate 1 is not able to be corrected to be plane. Moreover, it is possible to perform screen printing on the print substrate 1 that includes a curved surface having a larger curvature.

The printer 10 according to the above-mentioned embodiment has been explained to include four pairs of the pressing parts 16 as one example; however, not limited thereto. It is sufficient that the printer 10 includes the two or more pressing parts 16.

The printer 10 according to the above-mentioned embodiment has been explained to sequentially press the print substrate 1 from its front portion toward rear portion; however, not limited thereto. For example, when the print substrate 1 includes the protruding part 6 in the vicinity of the center of the print substrate 1 in the front-and-rear direction, the printer 10 may first press the print substrate 1 by using the second pressing parts 16B and/or the third pressing parts 16C. The printer 10 may press thereafter the print substrate 1 by using the first pressing parts 16A and the fourth pressing parts 16D. When the print substrate 1 does not include the protruding parts 6, the printer 10 may sequentially press the print substrate 1 by using the pressing parts 16 from its rear portion toward front portion.

Thus, it is possible to prevent a position of the print substrate 1 from deviating with respect to the pedestal 15 when the print substrate 1 is being pressed to be able to precisely perform the silkscreen printing. When a positional deviation of the print substrate 1 is suppressed, it is possible to prevent the pressing parts 16 from pressing the main body 3, and thus a design panel having a good appearance is able to be manufactured, so that it is possible to improve manufacturing efficiency.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printer comprising:

a holding part that holds a print substrate having a curved surface in a state where the print substrate is pressed and elastically deformed so that a curvature of the curved surface is small; and a printing part that performs silkscreen printing on a print surface of the print substrate held by the holding part, wherein the holding part includes:

a fixed part on which the print substrate is mounted, and a plurality of movable parts that has claw parts, the claw parts pressing a periphery of the print substrate that is mounted on the fixed part, the fixed part includes an insertion hole into which a protruding part is inserted, the protruding part being formed on an reverse surface of the print surface, and the movable parts press the print substrate in an order from a part in which the protruding part is formed to a part in which the reverse surface thereof is flat.

2. The printer according to claim 1, wherein the movable parts sequentially press the print substrate from one end toward another end of the print substrate.

3. The printer according to claim 1, wherein the movable parts press the print substrate in an order from a part having a small curvature of the curved surface to a part having a large curvature of the curved surface.

4. The printer according to claim 1, wherein the holding part makes the print surface plane.

5. The printer according to claim 1, wherein the printing part includes a squeegee that is according to a curved-surface shape of the elastically-deformed print surface.

6. A printing method comprising:

holding a print substrate having a curved surface in a state where the print substrate is pressed and elastically deformed so that a curvature of the curved surface is small, the holding including mounting a fixed part on the print substrate, and pressing a periphery of the print substrate that is mounted on the fixed part with claw parts of a plurality of movable parts;

performing silkscreen printing on a print surface of the print substrate held in the holding; and inserting a protruding part into an insertion hole of the fixed part, the protruding part being formed on a reverse surface of the print surface, wherein the movable parts press the print substrate in an order from a part in which the protruding part is formed to a part in which the reverse surface thereof is flat.

* * * * *